US007750550B2

(12) United States Patent
Kim et al.

(10) Patent No.: US 7,750,550 B2
(45) Date of Patent: Jul. 6, 2010

(54) SURFACE LIGHT SOURCE DEVICE HAVING AN ELECTRON EMITTER AND LIQUID CRYSTAL DISPLAY HAVING THE SAME

(75) Inventors: Hyoung-Joo Kim, Uiwang-si (KR); Sang-Yu Lee, Yongin-si (KR); In-Sun Hwang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 732 days.

(21) Appl. No.: 11/324,663

(22) Filed: Jan. 3, 2006

(65) Prior Publication Data

US 2006/0238107 A1 Oct. 26, 2006

(30) Foreign Application Priority Data

Apr. 23, 2005 (KR) ..... 10-2005-0033839

(51) Int. Cl.
*H01J 1/62* (2006.01)
*H01J 63/04* (2006.01)

(52) U.S. Cl. ..... 313/497; 313/495

(58) Field of Classification Search ..... None
See application file for complete search history.

(56) References Cited

U.S. PATENT DOCUMENTS

| | | | | |
|---|---|---|---|---|
| 5,347,201 | A * | 9/1994 | Liang et al. | 315/366 |
| 5,561,345 | A * | 10/1996 | Kuo | 313/495 |
| 5,977,703 | A * | 11/1999 | Ju et al. | 313/495 |
| 2005/0174038 | A1 * | 8/2005 | Lee et al. | 313/495 |
| 2005/0179363 | A1 * | 8/2005 | Choi et al. | 313/497 |
| 2006/0125375 | A1 * | 6/2006 | Hwang et al. | 313/496 |

FOREIGN PATENT DOCUMENTS

| | | | |
|---|---|---|---|
| JP | 2005044616 | * | 2/2005 |
| JP | 2005-063390 | | 10/2005 |

* cited by examiner

*Primary Examiner*—Toan Ton
*Assistant Examiner*—Britt D Hanley
(74) *Attorney, Agent, or Firm*—F. Chau & Associates, LLC

(57) ABSTRACT

A surface light source device comprises a lower substrate, a cathode electrode formed on the lower substrate, an electron emitter connected electrically to the cathode electrode, an upper substrate comprising a plurality of space parts and a plurality of space partitioning parts, wherein the plurality of space parts and the lower substrate form an emitting space over the electron emitter and the plurality of space partitioning parts divide adjacent space parts, and a fluorescent layer and an anode electrode formed on the upper substrate.

20 Claims, 12 Drawing Sheets

SURFACE LIGHT SOURCE DEVICE HAVING AN ELECTRON EMITTER AND LIQUID CRYSTAL DISPLAY HAVING THE SAME

CROSS-REFERENCE TO RELATED APPLICATION

This application claims priority to Korean Patent Application No. 2005-0033839, filed on Apr. 23, 2005, the disclosure of which is incorporated herein by reference.

BACKGROUND OF THE INVENTION

1. Technical Field

The present disclosure relates to a surface light source device and a liquid crystal display having the same, and more particularly, to a surface light source device and a liquid crystal display having the same using a field emission.

2. Discussion of the Related Art

A flat panel display apparatus, such as a liquid crystal display (LCD), a plasma display panel (PDP), and an organic light emitting diode (OLED), has been developed in place of a conventional display such as a cathode ray tube (CRT).

A liquid crystal display comprises an LCD panel having a TFT substrate and a color filter substrate, and liquid crystal disposed therebetween. Since the LCD panel does not emit light by itself, the LCD may comprise a backlight unit disposed behind the TFT substrate. The transmittance of the light from the backlight unit is adjusted according to an alignment of liquid crystal. The LCD panel and the backlight unit are accommodated in a chassis. The LCD may further comprise a circuit board and a driving chip to drive the LCD panel.

Light sources of a backlight unit include a Cold Cathode Fluorescent Lamp (CCFL), an External Electrode Fluorescent Lamp (EEFL), and a Flat Fluorescent lamp (FFL). These light sources use a plasma principle, and a discharging gas such as, for example, mercury (Hg), neon (Ne), and argon (Ar) is sealed in the lamp. When a high voltage is applied to an electrode of a lamp, an electron is emitted by an electric field from the electrode. The emitted electron excites, for example, mercury (Hg), thereby generating ultraviolet rays. Generated- ultraviolet rays are emitted outside and are converted into a visible ray by a fluorescent layer.

Mercury has desired efficiency, but due to environmental concerns associated with mercury, a light source not using mercury has been desired.

SUMMARY OF THE INVENTION

According to an embodiment of the present invention, a surface light source device comprises a lower substrate, a cathode electrode formed on the lower substrate, an electron emitter connected electrically to the cathode electrode, an upper substrate comprising a plurality of space parts and a plurality of space partitioning parts, wherein the plurality of space parts and the lower substrate form an emitting space over the electron emitter and the plurality of space partitioning parts divide adjacent space parts, and a fluorescent layer and an anode electrode formed on the upper substrate.

A plurality of supporting parts contacting the space partitioning parts may be disposed on the lower substrate.

The electron emitter may be disposed in the center between the adjacent supporting parts.

The space part may be extended lengthwise along a surface of the upper substrate.

The space parts may be disposed parallel with each other.

At least a part of the electron emitter may have an equal distance from the anode electrode.

The space part may be extended lengthwise along a surface of the upper substrate and a sectional view of the space part in a width direction is in a half circle shape bulged upwardly.

At least a part of the space part may be in a half spherical shape projecting upwardly.

A groove may be formed on the lower substrate and the electron emitter may be disposed on the groove.

The surface light source device may further comprise a gate electrode disposed higher than the cathode electrode and in a row with the electron emitter.

The upper substrate may have a wave shape.

The electron emitter may comprise a carbon nano tube.

The electron emitter may comprise a metal wire and a carbon nano tube encompassing the metal wire.

According to an embodiment of the present invention, an LCD comprises an LCD panel, and a surface light source device disposed in rear of the LCD panel and comprising a lower substrate, a cathode electrode formed on the lower substrate, an electron emitter connected electrically to the cathode electrode, an upper substrate comprising a plurality of space parts and a plurality of space partitioning parts, wherein the plurality of space parts and the lower substrate form an emitting space over the electron emitter and the plurality of space partitioning parts divide adjacent space parts, and a fluorescent layer and an anode electrode formed on the upper substrate.

A plurality of supporting parts contacting the space partitioning parts may be disposed on the lower substrate and the electron emitter may be disposed in the center between the adjacent supporting parts.

The space part may be extended lengthwise along a surface of the upper substrate and a sectional view of the space part in a width direction may be in a circle shape bulged upwardly.

At least a part of the space part may be in a half spherical shape projecting upwardly.

A groove may be formed on the lower substrate and the electron emitter may be disposed on the groove.

The LCD may further comprise a gate electrode disposed higher than the cathode electrode and in a row with the electron emitter.

The upper substrate may have a wave shape.

The electron emitter may comprise a carbon nano tube.

The LCD may further comprise a light diffusing part disposed between the LCD panel and the surface light source device. A light diffusion pattern may be formed on the surface light source. The light diffusion pattern may be densely disposed on an area corresponding to the space partitioning part.

BRIEF DESCRIPTION OF THE DRAWINGS

Preferred embodiments of the present disclosure can be understood in more detail from the following description taken in conjunction with the accompanying drawings in which.

DETAILED DESCRIPTION OF THE PREFERRED EMBODIMENTS

Preferred embodiments of the present invention will be described below in more detail with reference to the accompanying drawings. The present invention may, however, be embodied in many different forms and should not be construed as limited to the embodiments set forth herein.

Figure 1:
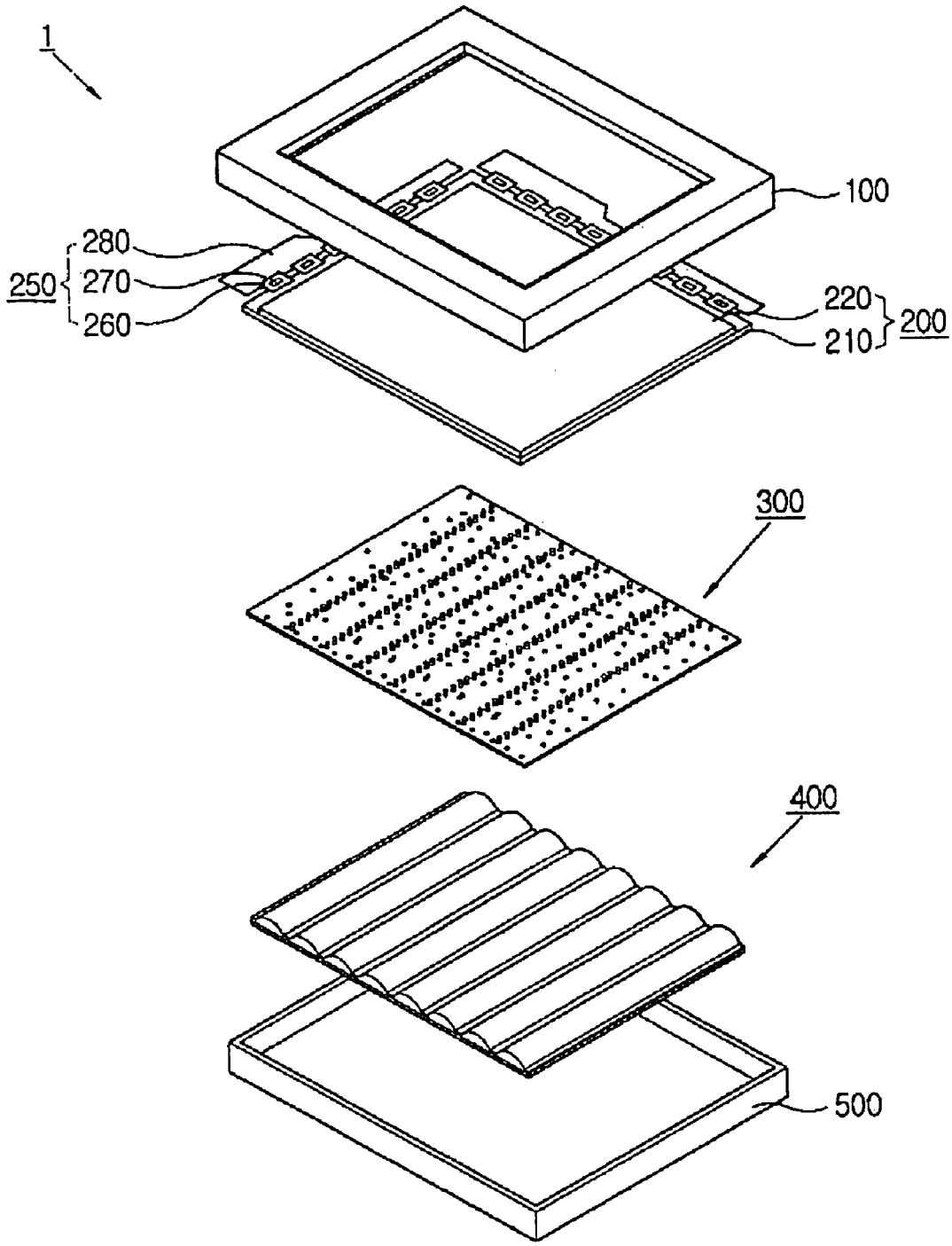
FIG. 1 is an exploded perspective view of an LCD according to an embodiment of the present invention.
Figure 2:
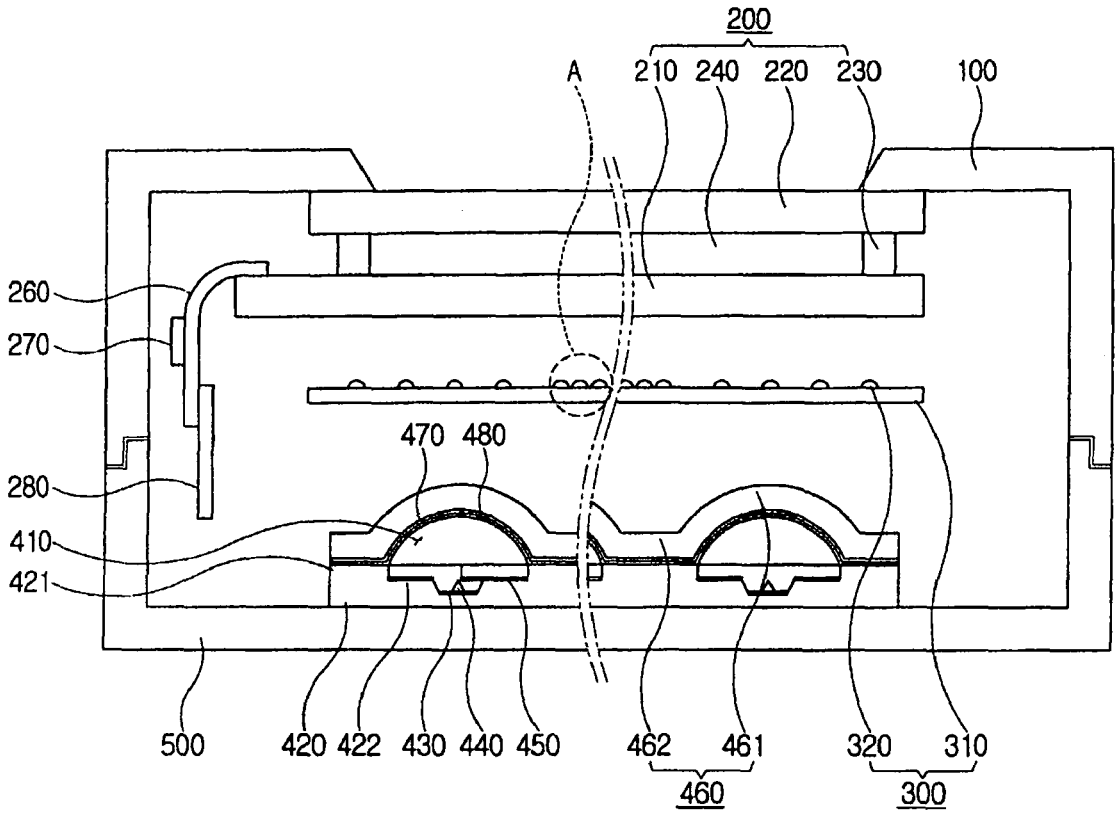
FIG. 2 is a sectional view of an LCD according to an embodiment of the present invention.
Figure 3:
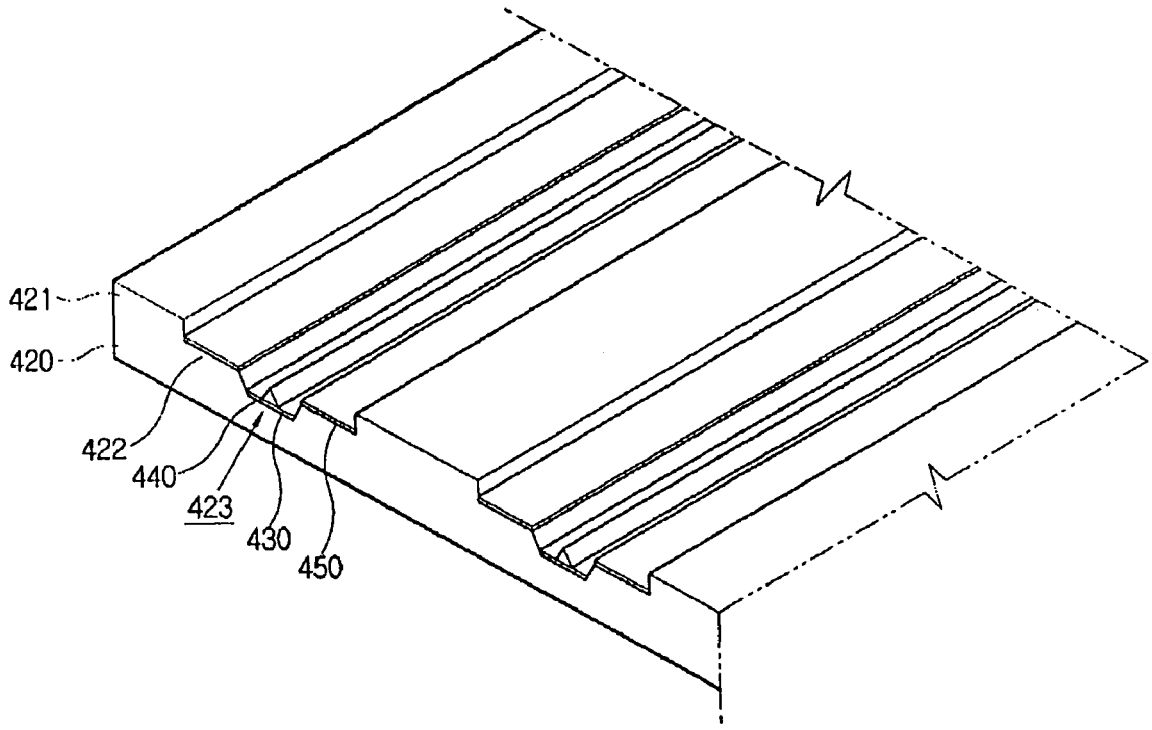
FIG. 3 is a perspective view of a lower substrate of a light source device of an LCD according to an embodiment of the present invention.

An embodiment of the present invention will be described referring to FIGS. 1 through 3.

An LCD 1 comprises an LCD panel 200, a light diffusing part 300 disposed behind the LCD panel 200, and a surface light source device 400 providing light to the light diffusing part 300. The LCD panel 200, the light diffusing part 300, and a surface light source device 400 are disposed between a top chassis 100 and a bottom chassis 500.

The LCD panel 200 comprises a TFT substrate 210 on which TFTs are formed, a color filter substrate 220 facing the TFT substrate 210, a sealant 230 attaching the two substrates 210 and 220 to each other and forming a cell gap, and a liquid crystal layer 240 positioned in the cell gap. The liquid crystal layer 240 is enclosed by the two substrates 210 and 220 and the sealant 230. The LCD panel 200 controls alignments of liquid crystal molecules in the liquid crystal layer 240, thereby forming an image thereon. The LCD panel 200 receives light from the surface light source part 400 disposed behind the LCD panel. On a side of the TFT substrate 210 is disposed a driving part 250 applying driving signals to the LCD panel 200. The driving part 250 comprises a flexible printed circuit (FPC) 260, a driving chip 270 disposed on the flexible printed circuit 260, and a printed circuit board (PCB) 280 connected on a side of the flexible printed circuit 260. In an embodiment of the present invention, the driving part 250 shown in FIG. 1 is formed in a chip on film (COF) type process. Alternatively, any known technology, such as, for example, tape carrier package (TCP) or chip on glass (COG). can be also applied. The driving part 250 can be formed on the TFT substrate 210 while wirings are formed.

The light diffusing part 300 disposed behind the LCD panel 200 may comprise a base film 310 and a light diffusion pattern 320 which is formed on the base film.

The base film 310 disposed parallel with the LCD panel 200 comprises a transparent substance. The light diffusion pattern 320 is in a lens form and is disposed on the base film 310 facing the LCD panel 200. The base film 310 comprises a transparent substance such as, for example, polyethylene terephthalate (PET), polycarbonate (PC), and cyclic olefin polymer (COP). The light diffusion pattern 320 may comprise the same substance as the base film 310. The light diffusion pattern 320 may comprise a single body with the base film 310. The light diffusion pattern 320 diffuses incident light and may have various forms such as, for example, a bead form. The light diffusion pattern 320 is disposed on an entire surface of the base film 310. The light diffusion pattern 320 is densely disposed on the area A, shown in FIG. 2, corresponding to a space partitioning part 462 of the surface light source device 400.

The surface light source device 400 using a field emission comprises a lower substrate 420 and an upper substrate 460. The lower substrate 420 and the upper substrate 460 are sealed to each other and an emitting space 410 is formed therebetween. The lower substrate 420 and the upper substrate 460 may comprise a transparent and insulating material such as glass or quartz.

On the lower substrate 420 are formed a supporting part 421 projected upwardly or away from the lower substrate 420, a gate electrode forming part 422 adjacent to the supporting part 421, and a groove 423 disposed in the center between adjacent supporting parts 421. The lower substrate 420 comprises a single body.

The supporting part 421 contacts the space partitioning part 462 of the upper substrate 460. The upper side of the supporting part 421 is flat. The supporting part 421 is extended in a surface direction of the lower substrate 420. Each supporting part 421 is disposed in parallel to other supporting parts at a regular interval.

The gate electrode forming part 422 on which a gate electrode 450 is formed is disposed lower than the supporting part 421, not projecting from the lower substrate as far as the supporting part 421. The gate electrode forming part 422 positioned between the adjacent supporting parts 421 is divided into two parts with the groove 423 as a center.

The groove 423 is disposed between the two parts of the gate electrode forming part 422. The groove 423 is extended in the surface direction of the lower substrate 420 similar to the supporting part 421. A sectional view of the groove 423 may be, for example, a round shape, a triangle shape or a trapezoid shape according to an embodiment of the present invention.

On the groove 423 are disposed a cathode electrode 430 and an electron emitter 440 electrically connected to the cathode electrode 430.

The cathode electrode 430 is extended along the groove 423 and comprises metal such as, for example, nickel (Ni) or chrome (Cr).

The electron emitter 440 emits an electron when voltage is applied from the cathode electrode 430. The electron emitter 440 may comprise a carbon nano tube. The electron emitter 440 according to an embodiment of the present invention comprises a carbon nano tube in a triangle shape. The carbon nano tube may be a single-wall structure or a multi-wall structure.

The gate electrode 450 is disposed on the gate electrode forming part 422 and may be disposed higher than the electron emitter 440. The gate electrode 450 comprises metal such as, for example, nickel (Ni) or chrome (Cr).

The upper substrate 460 comprises glass and is formed in a wave shape. The upper substrate 460 comprises a plurality of space parts 461 and space partitioning parts 462. The plurality of space parts 461 form the emitting space 410 with the lower substrate 420 over the electron emitter 440. The space partitioning part 462 is disposed between the adjacent space parts 461.

The space part 461 projects upwardly and its sectional view in a width direction has a half circle shape. In the center of the space part 461 is disposed the electron emitter 440. A distance from the electron emitter 440 to the space part 461 is equal to each part of the space part 461. The space partitioning part 462 subsides downward and contacts the supporting part 421, thereby distinguishing the adjacent space parts 461. Since the emitting space 410 between the upper substrate 460 and the lower substrate 420 is in a vacuum condition, a spacer can be used to maintain a distance between the two substrates 420, 460. Alternatively, a spacer can be omitted when the space partitioning part 462 maintains a distance between the two substrates 420, 460 while contacting the supporting part 421.

In the upper substrate 460 are formed an anode electrode 470 and a fluorescent layer 480 sequentially. The anode electrode 470 comprises, for example, ITO (indium tin oxide) or IZO (indium zinc oxide). The anode electrode 470 is a transparent conductor, and accelerates an electron generated in the electron emitter 440. The fluorescent layer 480 reacts with an incident electron for generating white light. The fluorescent layer 480 may use a 3-wave-length type of white group formed by mixing red, blue and green fluorescent substances. Alternatively, on the fluorescent layer 480 may be respectively disposed red, blue and green fluorescent substances at predetermined intervals, thereby providing each 3-color light. In an embodiment of the present invention, each 3-color light is mixed in a space between the surface light source device 400 and the LCD panel 200 and becomes white light.

In an alternative embodiment of the present invention, the anode electrode 470 may be formed on an outside of the upper substrate 460. In this embodiment, a protection layer can protect the anode electrode 470. A silicon nitride layer or a silicon oxide layer may be used for the protection layer. Although not shown in FIGS. 1 through 3, a black matrix may be formed in the space partitioning part 462.

The surface light source device 400 according to an embodiment of the present invention does not need an additional inverter for on/off unlike a conventional lamp. Thus a manufacturing process is simplified.

Figure 4:
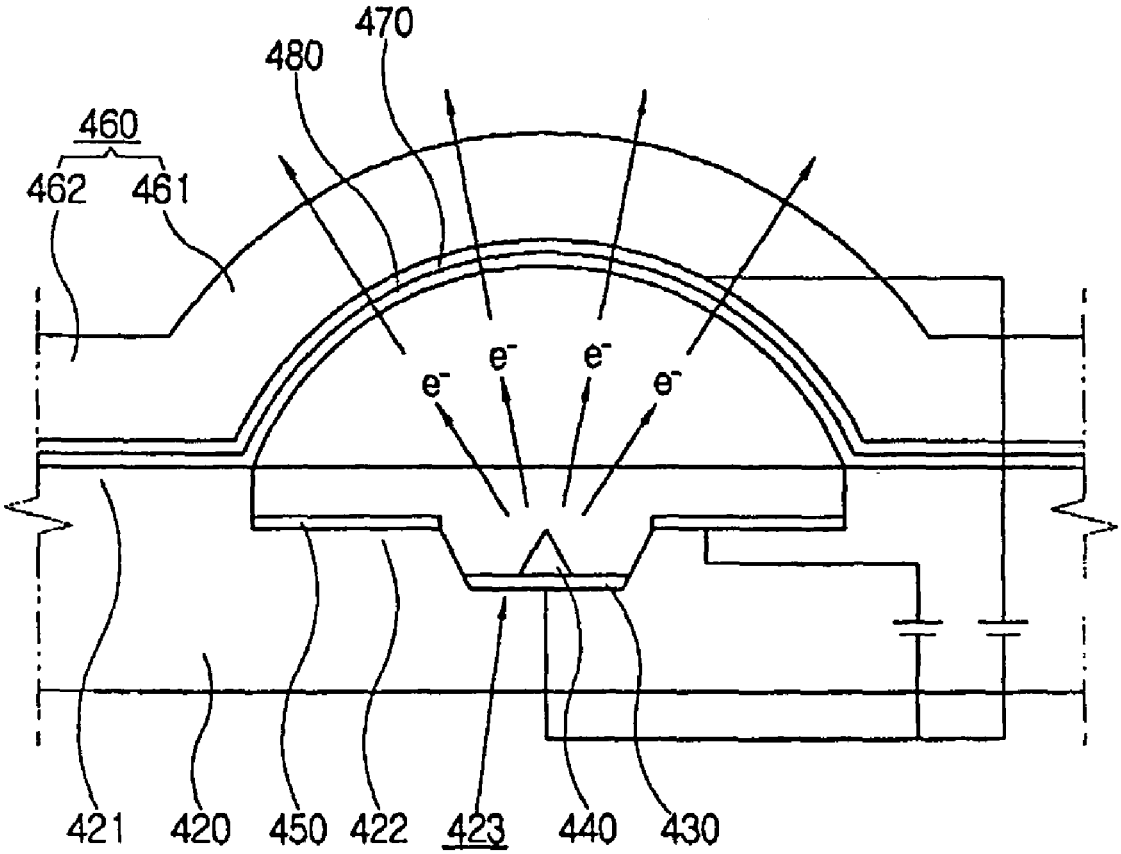
FIG. 4 illustrates the generation of light in an LCD according to an embodiment of the present invention.

Light generation in the surface light source device according to an embodiment will be described with reference to FIG. 4.

Between a cathode electrode 430 and a gate electrode 450 is applied pulse or square-type voltage. Between the cathode electrode 430 and an anode electrode 470 is applied a direct voltage. The voltage applied between the cathode electrode 430 and the gate electrode 450 may be from a few volts to several tens of volts. Frequency of the voltage between the cathode electrode 430 and the electrode 450 may be from a few kHz to several tens of kHz. The voltage applied between cathode electrode 430 and the anode electrode 470 may be several tens of kHz.

An electron is emitted from the electron emitter 440 as a result of the voltage applied between the cathode electrode 430 and the gate electrode 450. The gate electrode 450 makes electron emission from the electron emitter 440 efficient and increases a life span of the electron emitter 440. An emitted electron is accelerated due to the voltage applied between the cathode electrode 430 and the anode electrode 470 and is incident to the fluorescent layer 480. The fluorescent layer 480 reacts with an incident electron, thereby emitting a visible ray to outside.

In an embodiment of the present invention, since the space part 461 forms into a half circle with the electron emitter 440 as a center, time for which the emitted electron reaches the fluorescent layer 480 is substantially consistent. Accordingly, an electric field in the emitting space 410 is efficiently formed and light brightness generated by the surface light source device 400 is substantially uniform.

Light from the surface light source device 400 is generated in the space part 461, but not in the space partitioning part 462. Therefore, obscure rays may be generated on a screen along the space partitioning part 462. Referring to area A of FIG. 2, a light diffusing part 300 corresponding to the space partitioning part 462 diffuses light incident from the surface light source device 400, thereby removing the obscure rays from the space partitioning part 462. According to an embodiment of the present invention, in the area 'A', shown in FIG. 2, corresponding to the space partitioning part 462 is densely disposed the light diffusion pattern 320 as compared with other areas of the light diffusing part 300. As a result, diffusion in the area 'A' may be improved.

A manufacturing process of the surface light source device 400 according to an embodiment of the present invention will be described with referring to FIGS. 5A through 5D.

A lower substrate 420 as shown in FIGS. 5A-5D is prepared. On the lower substrate 420 are formed a supporting part 421, a gate electrode forming part 422, and a groove 423. The lower substrate 420 according to an embodiment of the present invention may be formed by grinding a glass substrate.

Figure 5A:
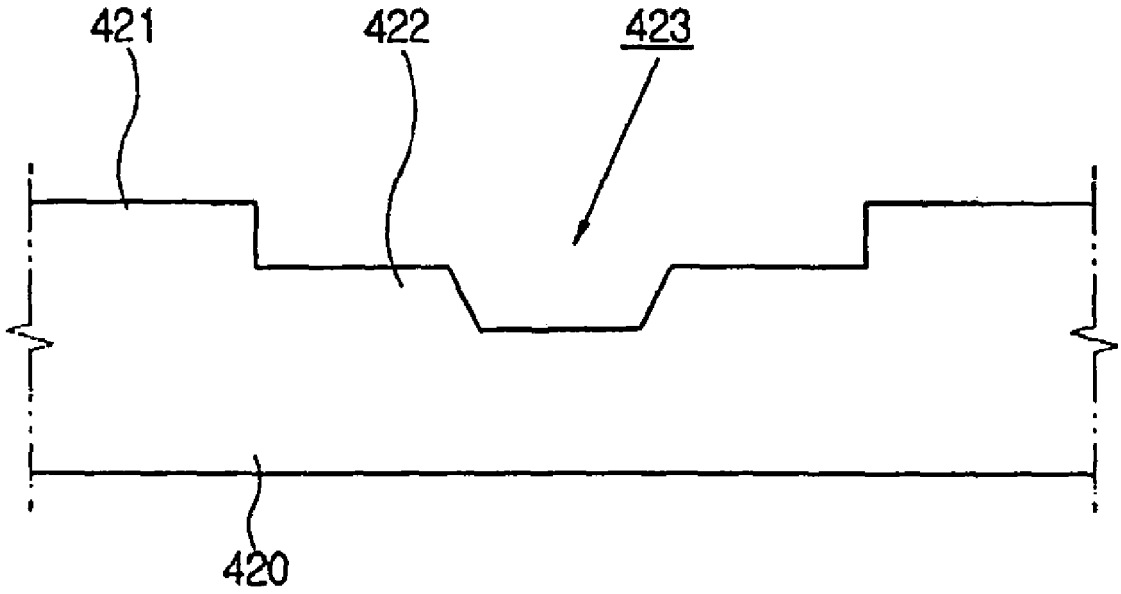
FIGS. 5A to 5D illustrate a manufacturing method of an LCD according to an embodiment of the present invention.
Figure 5B:
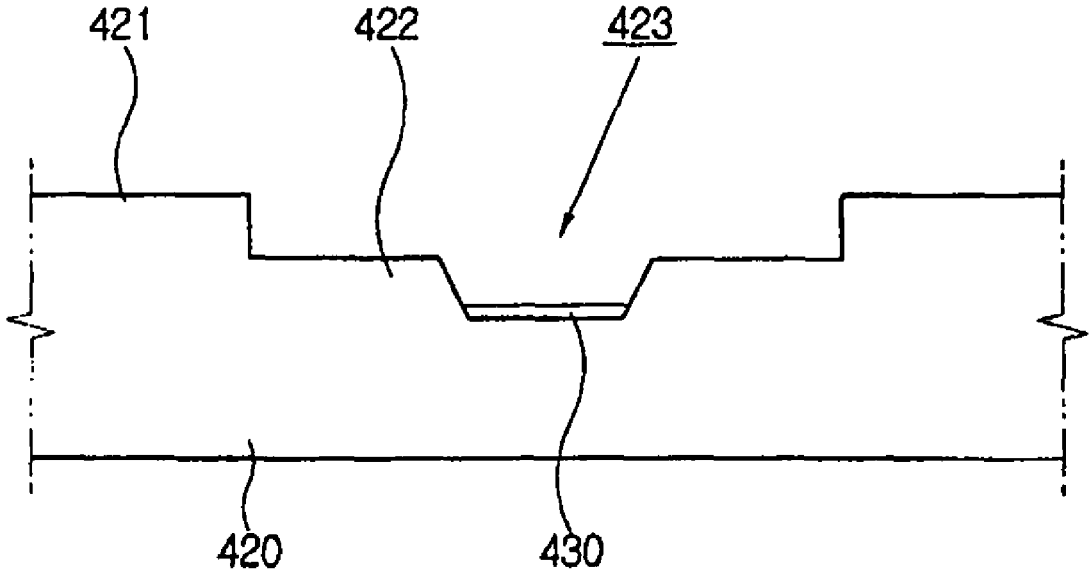

Next, on the groove 423 is formed a cathode electrode 430, as shown in FIG. 5B. The cathode electrode 430 may be formed by depositing nickel (Ni) or chrome (Cr) on the lower substrate 420 using a sputtering method and subsequently through a photo etching process.

Figure 5C:
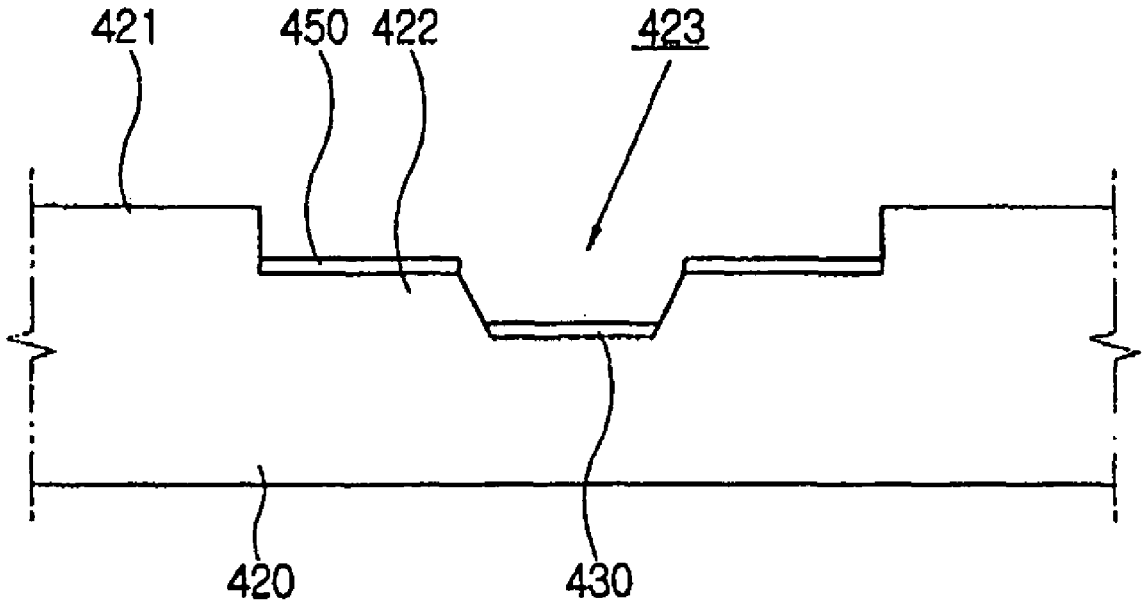

Next, on the gate forming part 422 is formed a gate electrode 450, as shown in FIG. 5C. The gate electrode 450 is formed by depositing nickel (Ni) or chrome (Cr) on the lower substrate 420 using a sputtering method and subsequently through a photo etching process.

The cathode electrode 430 and the gate electrode 450 may be formed at the same time according to an embodiment of the present invention.

Figure 5D:
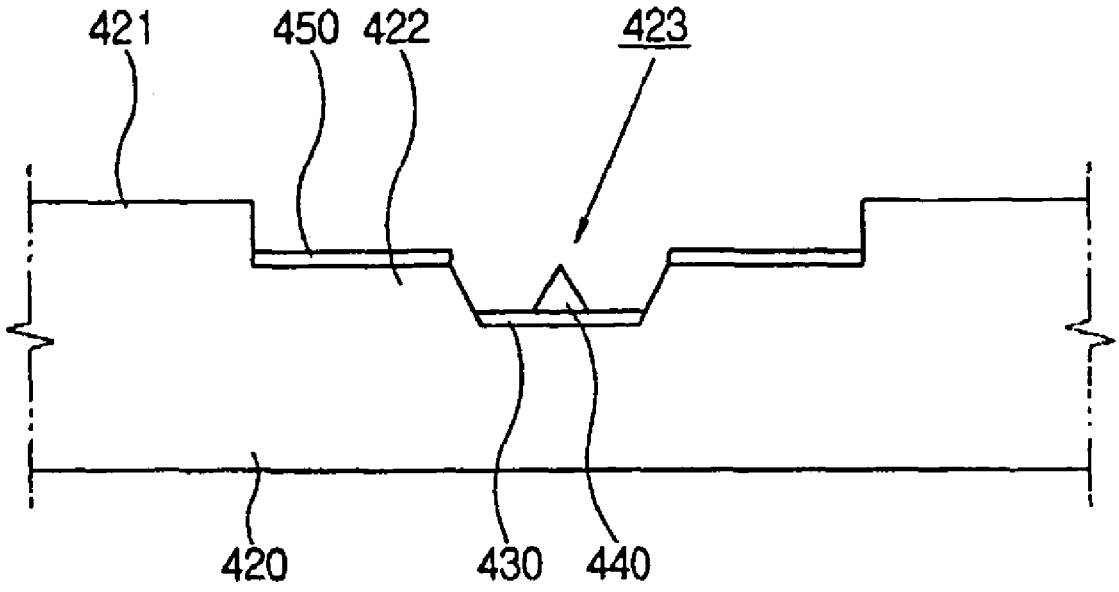

Next, an electron emitter 440 is formed on the cathode electrode 430, as shown in FIG. 5D. The electron emitter 440 may be formed by coating a carbon nano tube using a mask or drawing carbon nano tube paste.

Although not shown, an anode electrode 470 and a fluorescent layer 480 are sequentially deposited on an upper substrate 460. The upper substrate 460 may be formed in a wave shape.

The surface light source device 400 is completed when two substrates 420, 460 are adhered to each other and an emitting space 410 over the completed electron emitter 440 is made in a vacuum state. The emitting space 410 maintains preferably a high vacuum since cations generated by ionization of remaining gas deteriorate the electron emitter 440 and generate an arc discharge between the electron emitter 440 and the fluorescent layer 480. A vacuum degree of the emitting space 410 may be about $1\times10^{-7}$ Torr or less.

An LCD 1 according to additional embodiments of the present invention will be described with reference to FIGS. 6 and 7.

Figure 6:
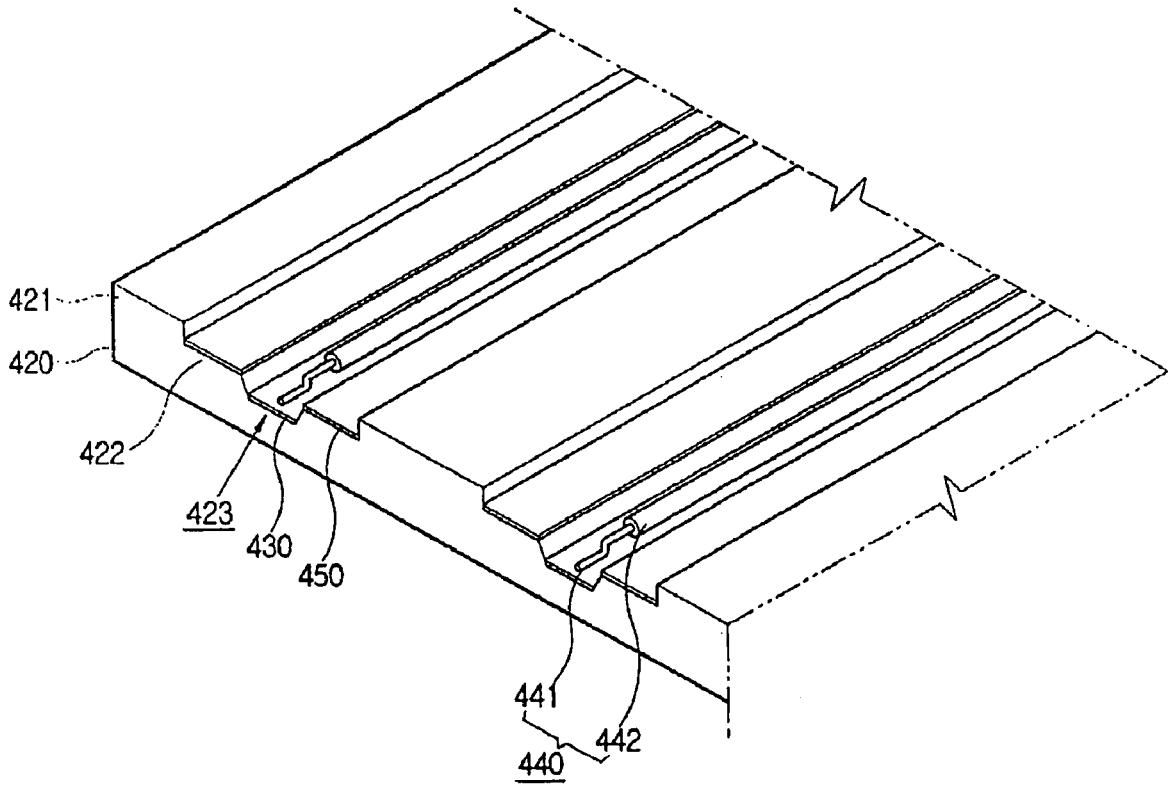
FIG. 6 is a perspective view of a lower substrate of a light source device of an LCD according to an embodiment of the present invention.

Referring to FIG. 6, an electron emitter 440 according to an embodiment of the present invention comprises a metal wire 441 formed lengthwise in an extended direction of the cathode electrode 430 and a carbon nano tube 442 enclosing the metal wire 441. The metal wire 441 comprises, for example, nickel (Ni) or copper (Cu). The end part of the wire 441 is not enclosed by the carbon nano tube 442 and the end-part is directly connected to the cathode electrode 430. In an embodiment of the present invention, the carbon nano tube 442 is not directly connected to the cathode electrode 430.

Figure 7:
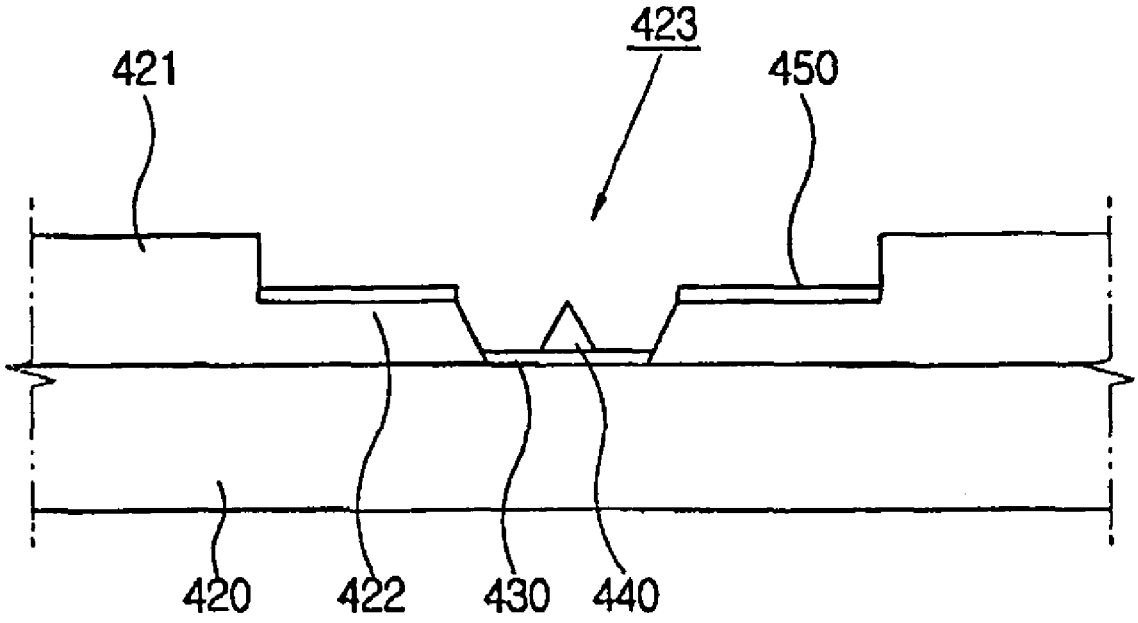
FIG. 7 is a sectional view of a lower substrate of a light source device of an LCD according to an embodiment of the present invention.

A lower substrate 420 according to the embodiment shown in FIG. 7 is a flat substrate which is not patterned unlike the lower substrate shown in FIGS. 2-5D. A supporting part 421 and a gate electrode forming part 422 disposed on the lower substrate 420 comprise an insulating material such as a silicon nitride or a silicon oxide. The supporting part 421 and the gate electrode forming part 422 may comprise different materials. A groove 423 is formed between the supporting parts 421. After an insulating material layer is formed on the lower substrate 420, the supporting part 421 and the groove 423 are formed thereon through a photo etching process.

According to an embodiment of the present invention, an upper substrate 460 in a wave shape may be used in connection with the lower substrates shown in FIGS. 6 and 7. Accordingly, as previously described, an additional spacer is not needed and a distance between at least a part of the electron emitter 440 and a fluorescent layer 480 is consistent.

A surface light source device 400 according to additional embodiments of the present invention will be described with reference to FIGS. 8 and 9.

Figure 8:
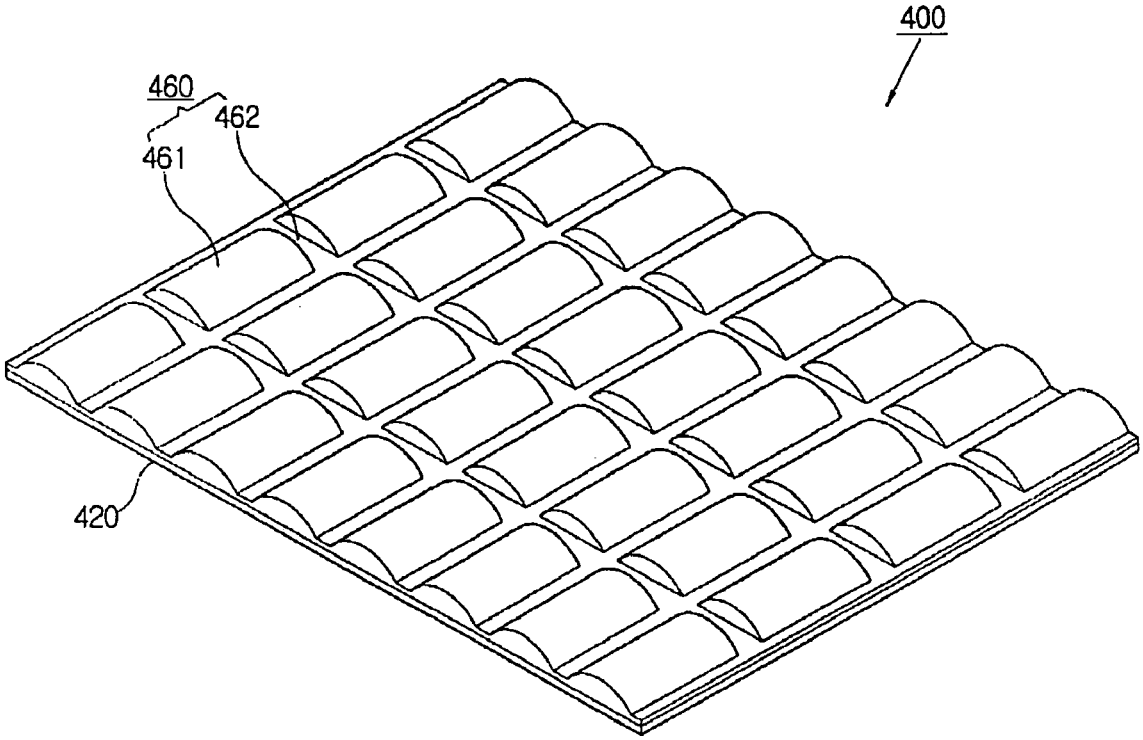
FIG. 8 is a perspective view of a light source device of an LCD according to an embodiment of the present invention.

As shown in FIG. 8, on an upper substrate 460 of the surface light source device 400 according to an embodiment of the present invention are disposed a plurality of space parts 461 in both width and length direction. Each space part 461 is formed in a half cylinder shape.

Figure 9:
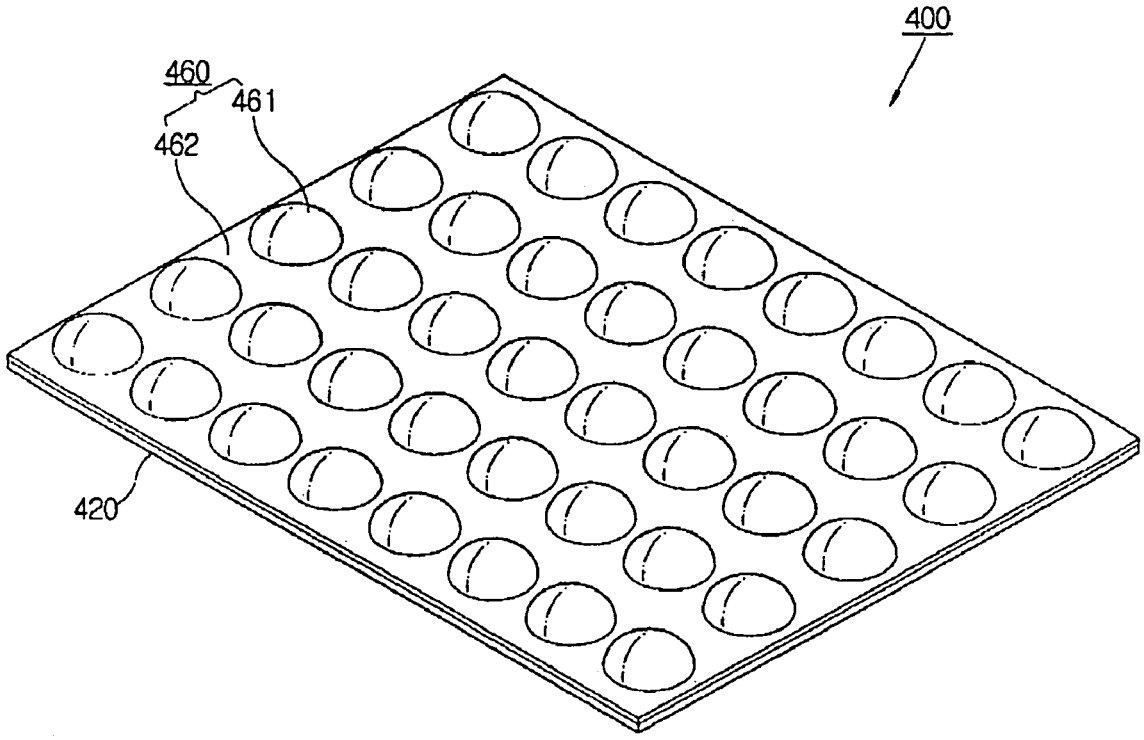
FIG. 9 is a perspective view of a light source device of an LCD according to an embodiment of the present invention.

As shown in FIG. 9, on an upper substrate 460 of the surface light source device 400 according to an embodiment of the present invention are disposed a plurality of space parts 461 in a half spherical shape. Each space part 461 is disposed regularly on the entire upper substrate.

In embodiments shown in FIGS. 8 and 9, an additional spacer is not needed, and a distance between the electron emitter 440 and a fluorescent layer 480 is consistent. The electron emitter 440 according to the embodiments shown in FIGS. 8 and 9 is not limited to a linear shape and may be disposed at each space part 461 separately.

A use of the surface light source device 400 according to embodiments of the present invention is not limited to a backlight of the LCD and may be used, for example, for a general lighting apparatus.

Although preferred embodiments have been described herein with reference to the accompanying drawings, it is to be understood that the present invention is not limited to those precise embodiments but various changes and modifications can be made by one skilled in the art without departing from the spirit and scope of the present invention. All such changes and modifications are intended to be included within the scope of the invention as defined by the appended claims.

What is claimed is:

1. A surface light source device comprising:

a lower substrate including a groove extending in a direction, a gate electrode forming part adjacent to the groove, and a supporting part adjacent to the gate electrode forming part, the supporting part disposed higher than the groove and the gate electrode forming part;

a cathode electrode formed on the lower substrate;

an electron emitter electrically connected to the cathode electrode;

an upper substrate comprising a plurality of space parts and a plurality of space partitioning parts, each of the space parts and the space partitioning parts extending in the direction, each of the space parts facing the groove, wherein the electron emitter is positioned in the groove below an upper surface of the lower substrate, wherein the plurality of space parts and the lower substrate form an emitting space over the electron emitter and the plurality of space partitioning parts divide adjacent space parts; and a fluorescent layer formed on the upper substrate; and an anode electrode formed on the upper substrate, the anode electrode comprising a transparent material so that a light emitted from the fluorescent layer is transmitted to an outside of the upper substrate through the anode electrode, wherein the space partitioning parts contact the supporting part of the lower substrate.

2. The surface light source device according to claim 1, wherein the electron emitter is disposed in a center between the adjacent supporting parts.

3. The surface light source device according to claim 1, wherein each of the plurality of space parts is extended lengthwise along a surface of the upper substrate.

4. The surface light source device according to claim 3, wherein the plurality of space parts are disposed parallel with each other.

5. The surface light source device according to claim 1, wherein at least a part of the electron emitter has a consistent distance from the anode electrode.

6. The surface light source device according to claim 5, wherein each of the plurality of space parts is extended lengthwise along a surface of the upper substrate and each of the plurality of space parts in a width direction is in a half circle shape.

7. The surface light source device according to claim 5, wherein at least a part of each of the plurality of space parts is in a half spherical shape.

8. The surface light source device according to claim 1; further comprising a gate electrode disposed in a different plane than the cathode electrode.

9. The surface light source device according to claim 1, wherein the upper substrate has a wave shape.

10. The surface light source device according to claim 1, wherein the electron emitter comprises a carbon nano tube.

11. The surface light source device according to claim 1, wherein the electron emitter comprises a metal wire and a carbon nano tube enclosing at least a part of the metal wire.

12. A liquid crystal display comprising:

a liquid crystal display panel; and a light source device disposed behind the liquid crystal display panel and comprising a lower substrate including a groove extending in a direction, a gate electrode forming part adjacent to the groove, a supporting part adjacent to the gate electrode forming part, a cathode electrode formed on the lower substrate, an electron emitter electrically connected to the cathode electrode, an upper substrate comprising a plurality of space parts and a plurality of space partitioning parts, each of the space parts and the space partitioning parts extending in the direction, each of the space parts facing the groove, wherein the electron emitter is positioned in the groove below an upper surface of the lower substrate and the supporting part is disposed higher than the groove and the gate electrode forming part, wherein the plurality of space parts and the lower substrate form an emitting space over the electron emitter and the plurality of space partitioning parts divide adjacent space parts, and wherein a fluorescent layer and an anode electrode are formed on the upper substrate, and wherein the anode electrode comprises a transparent material so that a light emitted from the fluorescent layer is transmitted to an outside of the upper substrate through the anode electrode, wherein the space partitioning parts contact the supporting part of the lower substrate.

13. The liquid crystal display according to claim 12, wherein the electron emitter is disposed in a center between the adjacent supporting parts.

14. The liquid crystal display according to claim 12, wherein each of the plurality of space parts is extended lengthwise along a surface of the upper substrate and each of the plurality of space parts in a width direction is in a circle shape.

15. The liquid crystal display according to claim 12, wherein at least a part of each of the plurality of space parts is in a half spherical shape.

16. The liquid crystal display according to claim 12, further comprising a gate electrode disposed in a different plane than the cathode electrode.

17. The liquid crystal display according to claim 12, wherein the upper substrate has a wave shape.

18. The liquid crystal display according to claim 12, wherein the electron emitter comprises a carbon nano tube.

19. The liquid crystal display according to claim 12, further comprising a light diffusing part disposed between the liquid crystal display panel and the surface light source device and on which a light diffusion pattern is formed, wherein the light diffusion pattern is densely disposed in an area corresponding to each of the plurality of space partitioning parts.

20. A light source device for a liquid crystal display comprising:

a lower substrate including a groove extending in a direction, a gate electrode forming part adjacent to the groove, and a supporting part adjacent to the gate electrode forming part, the supporting part disposed higher than the groove and the gate electrode forming part;

a cathode electrode formed on the lower substrate;

an electron emitter electrically connected to the cathode electrode; and an upper substrate comprising a plurality of space parts and a plurality of space partitioning parts, each of the space parts and the space partitioning parts extending in the direction, each of the space parts facing the groove, wherein the electron emitter is positioned in the groove below an upper surface of the lower substrate, wherein the plurality of space parts and the lower substrate form an emitting space over the electron emitter and the plurality of space partitioning parts divide adjacent space parts, wherein the space partitioning parts contact the supporting part of the lower substrate.

* * * * *